US010943525B2

(12) United States Patent
Chen

(10) Patent No.: US 10,943,525 B2
(45) Date of Patent: Mar. 9, 2021

(54) DISPLAY DEVICE AND MULTIPLEXER THEREOF

(71) Applicant: AU Optronics Corporation, Hsin-Chu (TW)

(72) Inventor: Ping-Lin Chen, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/458,247

(22) Filed: Jul. 1, 2019

(65) Prior Publication Data

US 2020/0226972 A1 Jul. 16, 2020

(30) Foreign Application Priority Data

Jan. 16, 2019 (TW) ..... 108101694

(51) Int. Cl.
*G09G 3/20* (2006.01)
*G09G 3/36* (2006.01)

(52) U.S. Cl.
CPC ..... *G09G 3/2092* (2013.01); *G09G 3/3677* (2013.01); *G09G 3/3685* (2013.01); *G09G 3/3688* (2013.01); *G09G 2300/08* (2013.01); *G09G 2300/0871* (2013.01); *G09G 2310/0297* (2013.01); *G09G 2330/021* (2013.01)

(58) Field of Classification Search
CPC ..... G09G 2310/0297; G09G 2310/027; G09G 2310/08; G09G 2310/0286; G09G 2330/021; G09G 3/2092; G09G 3/3688; G09G 3/3696
See application file for complete search history.

(56) References Cited

U.S. PATENT DOCUMENTS 6,937,687 B2 * 8/2005 Yu ..... G11C 19/00 345/100
7,570,242 B2 * 8/2009 Kwon ..... G09G 3/3233 341/144
8,581,758 B2 * 11/2013 Teramoto ..... H03K 19/1737 327/408
9,830,874 B2 * 11/2017 Kuo ..... G09G 3/3685
9,934,719 B2 * 4/2018 Wang ..... G09G 3/3233
10,282,008 B2 * 5/2019 Chung ..... G06F 3/04166
10,304,401 B2 * 5/2019 Zuo ..... G09G 3/3648
10,559,274 B2 * 2/2020 Xi ..... G09G 3/006
10,636,377 B2 * 4/2020 Cheng ..... G09G 3/3688
10,803,835 B2 * 10/2020 Chen ..... G09G 3/20
(Continued)

FOREIGN PATENT DOCUMENTS

TW I656735 B 4/2019

*Primary Examiner* — Dismery Mercedes
(74) *Attorney, Agent, or Firm* — WPAT, PC

(57) ABSTRACT

A display device comprises a plurality of pixels and a plurality of multiplexers. Each of the plurality of multiplexers is coupled with N data lines, and configured to receive N−1 switching signals and a data signal. N is a positive integer larger than or equal to 3, and each of the N data lines is coupled with one column of pixels of the plurality of pixels. When any of the N−1 switching signals has an enabling voltage level, the multiplexer is disabled from transmitting the data signal to an N-th data line of the N data lines. When each of the N−1 switching signals has a disabling voltage level, the multiplexer transmits the data signal to the N-th data line.

8 Claims, 6 Drawing Sheets

(56) References Cited

U.S. PATENT DOCUMENTS

| | | | | |
|---|---|---|---|---|
| 2005/0156862 | A1* | 7/2005 | Hirayama | G09G 3/3688 345/100 |
| 2007/0057877 | A1* | 3/2007 | Choi | G09G 3/3291 345/76 |
| 2007/0091050 | A1* | 4/2007 | Katayama | G09G 3/3688 345/98 |
| 2010/0259523 | A1* | 10/2010 | Huang | G09G 3/3688 345/211 |
| 2013/0127697 | A1* | 5/2013 | Lin | G09G 3/3611 345/90 |
| 2013/0127806 | A1* | 5/2013 | Wu | G09G 3/3688 345/211 |
| 2016/0078845 | A1* | 3/2016 | Lin | G09G 3/20 345/213 |
| 2017/0061890 | A1* | 3/2017 | Zhou | G09G 3/3275 |
| 2019/0156764 | A1* | 5/2019 | Kim | G09G 3/3685 |
| 2020/0051486 | A1* | 2/2020 | Chang | G09G 3/2085 |

* cited by examiner

DISPLAY DEVICE AND MULTIPLEXER THEREOF

CROSS-REFERENCE TO RELATED APPLICATION

This application claims priority to Taiwan Application Serial Number 108101694, filed Jan. 16, 2019, which is herein incorporated by reference in its entirety.

BACKGROUND

Field of Invention

The present disclosure relates to a display device and a multiplexer. More particularly, the present disclosure relates to the display device and the multiplexer capable of reducing impulse noises.

Description of Related Art

Common display devices use multiplexers to write data signals into columns of pixels, so as to reduce a number of pins required by driver IC. However, numerous of parasitic elements exist in the display device, and thus switching signals for controlling the multiplexers induce impulse noises in other signals during rising edges and falling edges of the switching signals. As a result, the display device acts erroneously. For example, if the display device is an integrated display device which has display function and touch sensing function, the impulse noises induced by the switching signals causes deleterious effects on precision of the touch sensing function.

For reducing the number of the impulse noises induced by the switching signals, industries developed a solution which is to omit one switch in each of the multiplexers. However, in the solution, the multiplexer simultaneously transmits data signal to a path coupled with a switch and to a path whose switch is omitted. As a result, regarding the path coupled with the switch, charging speed of the multiplexer is decreased. Accordingly, if the foregoing solution is applied to a high-resolution display, pixels in the high-resolution display will encounter problems of insufficient charging currents.

SUMMARY

The disclosure provides a display device comprising a plurality of pixels. The display device further comprises a plurality of multiplexers. Each of the plurality of multiplexers is coupled with N data lines, and configured to receive N−1 switching signals and a data signal. N is a positive integer larger than or equal to 3, and each of the N data lines is coupled with one column of pixels of the plurality of pixels. When any of the N−1 switching signals has an enabling voltage level, the multiplexer is disabled from transmitting the data signal to an N-th data line of the N data lines. When each of the N−1 switching signals has a disabling voltage level, the multiplexer transmits the data signal to the N-th data line.

The disclosure provides a multiplexer applicable to a display device comprising a plurality of pixels. The multiplexer is coupled with N data lines, and configured to receive N−1 switching signals and a data signal. N is a positive integer larger than or equal to 3, and each of the N data lines is coupled with a column of pixels of the plurality of pixels. When any of the N−1 switching signals has an enabling voltage level, the multiplexer is disabled from transmitting the data signal to a N-th data line of the N data lines. When each of the N−1 switching signals has a disabling voltage level, the multiplexer transmits the data signal to the N-th data line.

It is to be understood that both the foregoing general description and the following detailed description are by examples, and are intended to provide further explanation of the disclosure as claimed.

DETAILED DESCRIPTION

Figure 1:
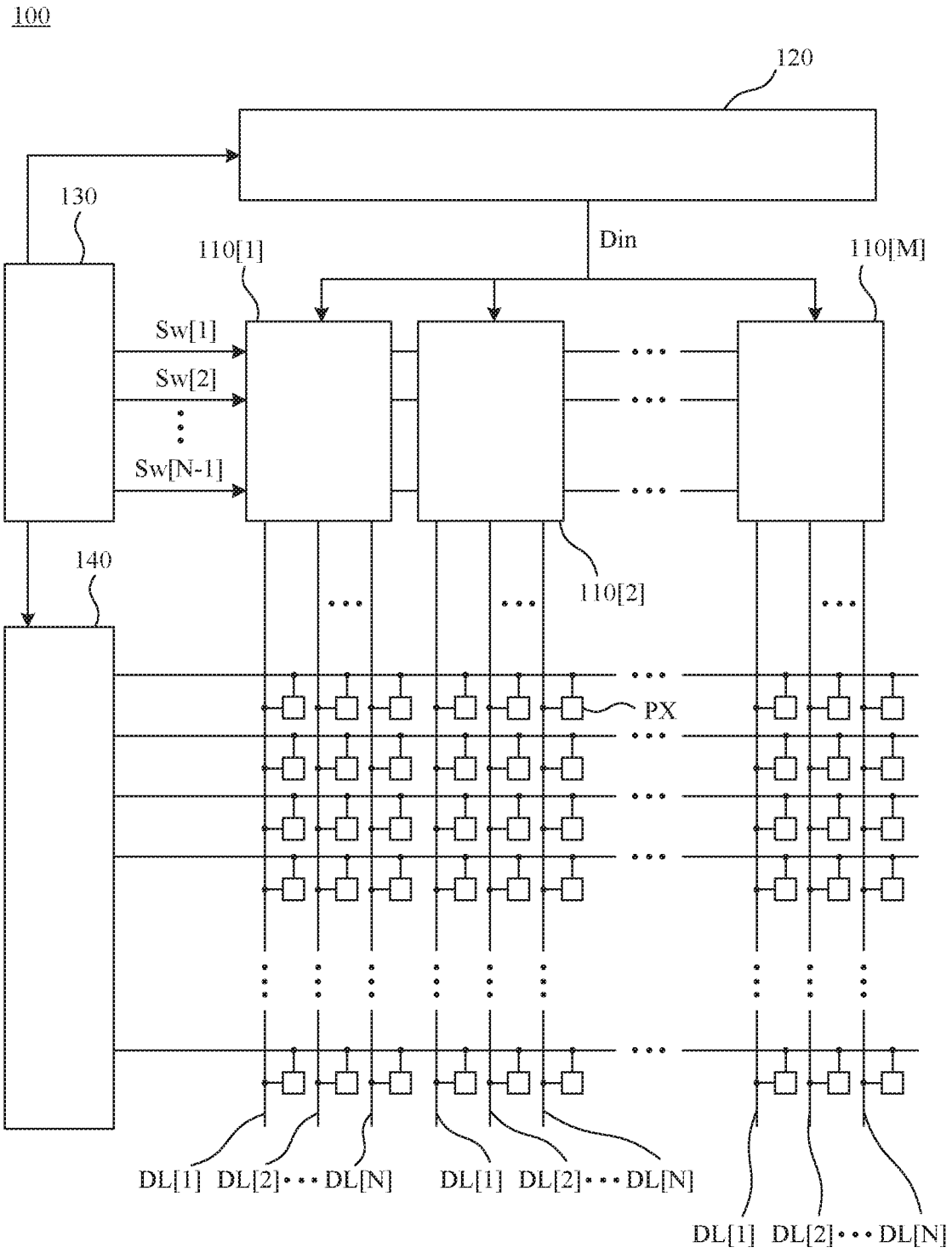
FIG. 1 is a simplified functional block diagram of a display device according one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a simplified functional block diagram of a display device 100 according one embodiment of the present disclosure. The display device 100 comprises a plurality of multiplexers 110[1]-110[M], a source driver 120, a timing control circuit 130, a gate driver 140, and a plurality of pixels PX. Each of the multiplexers 110[1]-110[M] is configured to receive a data signal Din from the source driver 120, and configured to receive a plurality of switching signals Sw[1]-Sw[N−1] from the timing control circuit 130. Each of the multiplexers 110[1]-110[M] is further configured to output the data signal Din to the data lines DL[1]-DL[N] according to the switching signals Sw[1]-Sw[N−1]. The data lines DL[1]-DL[N] are each coupled with a column of pixels PX of the plurality of pixels PX. The gate driver 140 is configured to sequentially enable rows of the plurality of pixels PX, so that the rows of the plurality of pixels PX may sequentially receive the data signal Din from the data lines DL[1]-DL[N]. For the sake of brevity, other functional blocks of the display device 100 are not shown in FIG. 1.

In this embodiment, N is a positive integer larger than or equal to 3. In practice, the timing control circuit 130 and the source driver 120 may be realized by different circuit blocks on a same substrate. However, the timing control circuit 130 and the source driver 120 may also be fabricated on different substrates, and coupled with each other through a flexible print circuit (FPC). In some embodiments, the timing control circuit 130 and the source driver 120 are fabricated as a single chip.

Throughout the specification and drawings, indexes [1]-[M] and [1]-[N] may be used in the reference labels of components and signals for ease of referring to respective components and signals. The use of indexes [1]-[M] and

[1]-[N] does not intend to restrict the amount of components and signals to any specific number. In the specification and drawings, if a reference label of a particular component or signal is used without having the index, it means that the reference label is used to refer to any unspecific component or signals of corresponding component group or signals group. For example, the reference label 110[1] is used to refer to the specific multiplexer 110[1], and the reference label 110 is used to refer to any unspecific multiplexer of the multiplexers 110[1]-110[N].

With respect to an unspecific multiplexer 110, the multiplexer 110 outputs the data signal Din to the data lines DL[1]-DL[N] according to the switching signals Sw[1]-Sw[N−1]. For example, when the switching signal Sw[1] has an enabling voltage level, the multiplexer 110 outputs the data signal Din to the data line DL[1]. In another example, when the switching signal Sw[2] has the enabling voltage level, the multiplexer 110 outputs the data signal Din to the data line DL[2]. In yet another example, when the switching signal Sw[N−1] has the enabling voltage level, the multiplexer 110 outputs the data signal Din to the data line DL[N−1], and so forth.

Notably, when any of the switching signals Sw[1]-Sw[N−1] has the enabling voltage level, the multiplexer 110 is disabled from output the data signal Din to the data line DL[N]. Until each of the switching signals Sw[1]-Sw[N−1] has the disabling voltage level, the multiplexer 110 transmits the data signal Din to the data line DL[N]. As a result, the multiplexer 110 is disabled from transmitting the data signal Din to two of the data lines DL[1]-DL[N] in a same time, so as to reduce the output loading of the multiplexer 110 and to increase charging speed.

Figure 2:
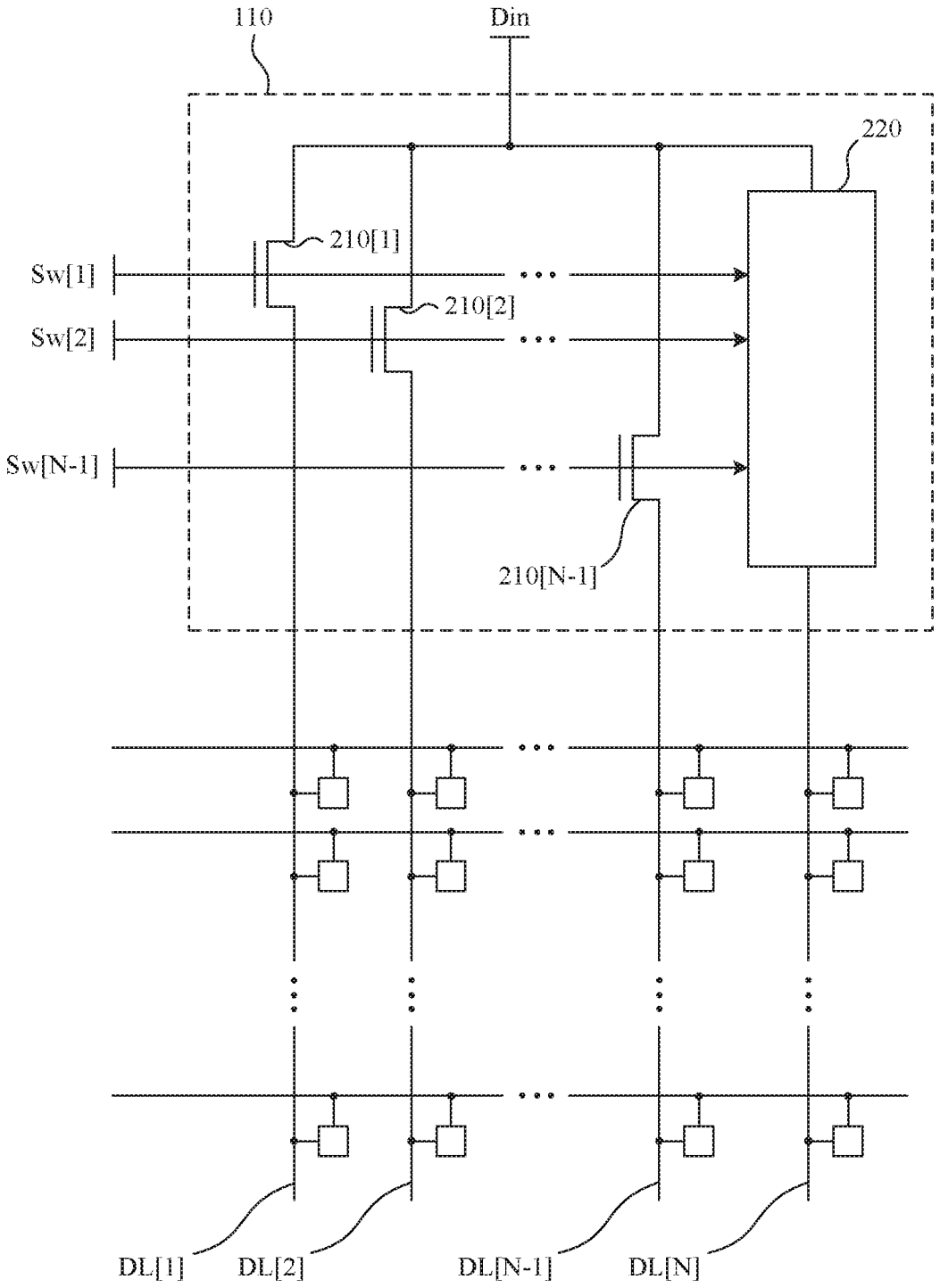
FIG. 2 is a simplified functional block diagram of the multiplexer according to one embodiment of the present disclosure.

FIG. 2 is a simplified functional block diagram of the multiplexer 110 according to one embodiment of the present disclosure. The multiplexer 110 comprises a plurality of current-dividing switches 210[1]-210[N−1] and a current-dividing element 220. With respect to an unspecific current-dividing switch 210, the current-dividing switch 210 comprises a first node, a second node, and a control node. The first node of the current-dividing switch 210 is correspondingly coupled with one of the data lines DL[1]-DL[N]. For example, the first node of the current-dividing switch 210[1] is coupled with the data line DL[1], the first node of the current-dividing switch 210[2] is coupled with the data line DL[2], the first node of the current-dividing switch 210[N−1] is coupled with the data line DL[N−1], and so forth.

The second node of the current-dividing switch 210 is configured to receive the data signal Din. The control node of the current-dividing switch 210 is configured to correspondingly receive one of the switching signals Sw[1]-Sw[N−1]. For example, the control node of the current-dividing switch 210[1] is configured to receive the switching signal Sw[1], the control node of the current-dividing switch 210[2] is configured to receive the switching signal Sw[2], the control node of the current-dividing switch 210[N−1] is configured to receive the switching signal Sw[N−1], and so forth.

The current-dividing element 220 is configured to receive the switching signals Sw[1]-Sw[N−1] and the data signal Din, and coupled with the data line DL[N]. In practice, the current-dividing switches 210[1]-210[N−1] can be realized by various categories of N-type transistors, such as N-type thin-film transistors (TFTs).

Figure 3:
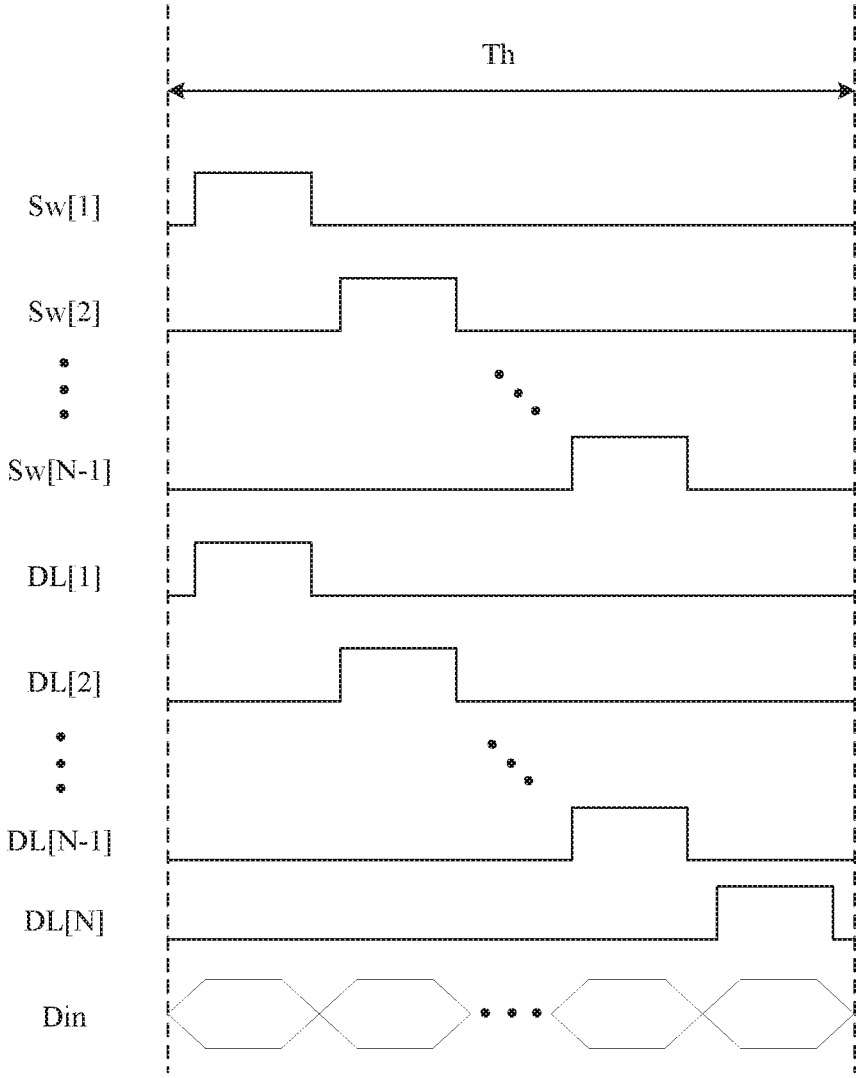
FIG. 3 is a timing diagram of the multiplexer according to one embodiment of the present disclosure.

FIG. 3 is a timing diagram of the multiplexer 110 according to one embodiment of the present disclosure. Operations of the multiplexer 110 will be further described in the following by reference to FIGS. 2 and 3. As shown in FIG. 3, the switching signals Sw[1]-Sw[N−1] are sequentially switched to the enabling voltage level (e.g., a high voltage level) during a time period Th, so that the current-dividing switches 210[1]-210[N−1] are sequentially conducted. As a result, the data lines DL[1]-DL[N−1] sequentially receive the data signal Din.

When any of the switching signals Sw[1]-Sw[N−1] has the enabling voltage level, the current-dividing element 220 is disabled from transmitting the data signal Din to the data line DL[N]. Until each of the switching signals Sw[1]-Sw[N−1] has the disabling voltage level (e.g., a low voltage level), the current-dividing element 220 transmits the data signal Din to the data line DL[N].

In practice, the time period Th may have a length equal to that of a horizontal line time of a row of pixels PX. For example, if the display device 100 having a resolution of 4096×2160 and a frame rate of 120 Hz, the time period Th may be approximate 3.86 μS.

Figure 4:
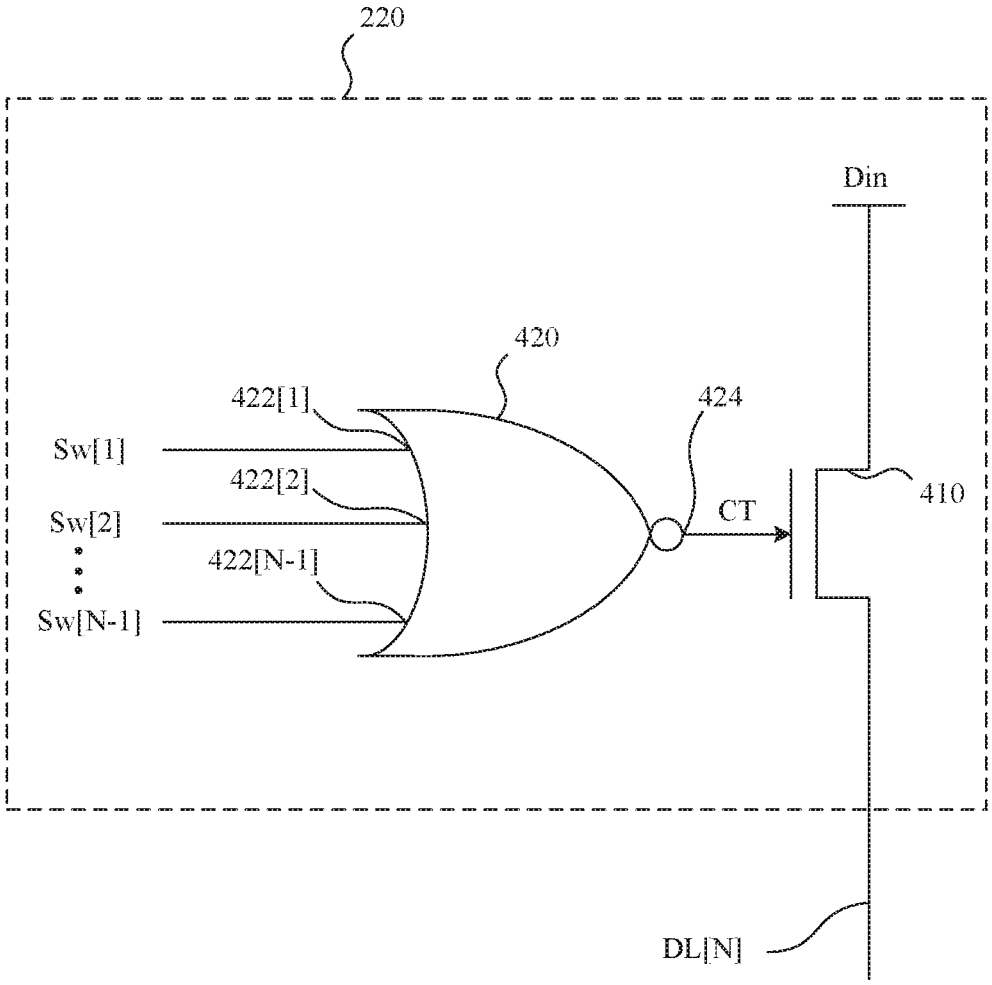
FIG. 4 is a simplified functional block diagram of a current-dividing element according to one embodiment of the present disclosure.

FIG. 4 is a simplified functional block diagram of a current-dividing element 220 according to one embodiment of the present disclosure. The current-dividing element 220 comprises a driving transistor 410 and a NOR gate 420. The driving transistor 410 comprises a first node, a second node, and a control node. The first node of the driving transistor 410 is coupled with the data line DL[N]. The second node of the driving transistor 410 is configured to receive the data signal Din.

The NOR gate 420 comprises a plurality of input nodes 422[1]-422[N−1] and an output node 424. The input nodes 422[1]-422[N−1] are configured to correspondingly receive the switching signals Sw[1]-Sw[N−1]. The output node 424 is coupled with the control node of the driving transistor 410, and configured to output the control signal CT. When one of the switching signals Sw[1]-Sw[N−1] has the enabling voltage level, the NOR gate 420 outputs the control signal CT having the disabling voltage level to the control node of the driving transistor 410. As a result, the driving transistor 410 is switched-off. On the other hand, when each of the switching signals Sw[1]-Sw[N−1] has the disabling voltage level, the NOR gate 420 outputs the control signal CT having the enabling voltage level to the control node of the driving transistor 410. As a result, the driving transistor 410 is conducted.

Figure 5:
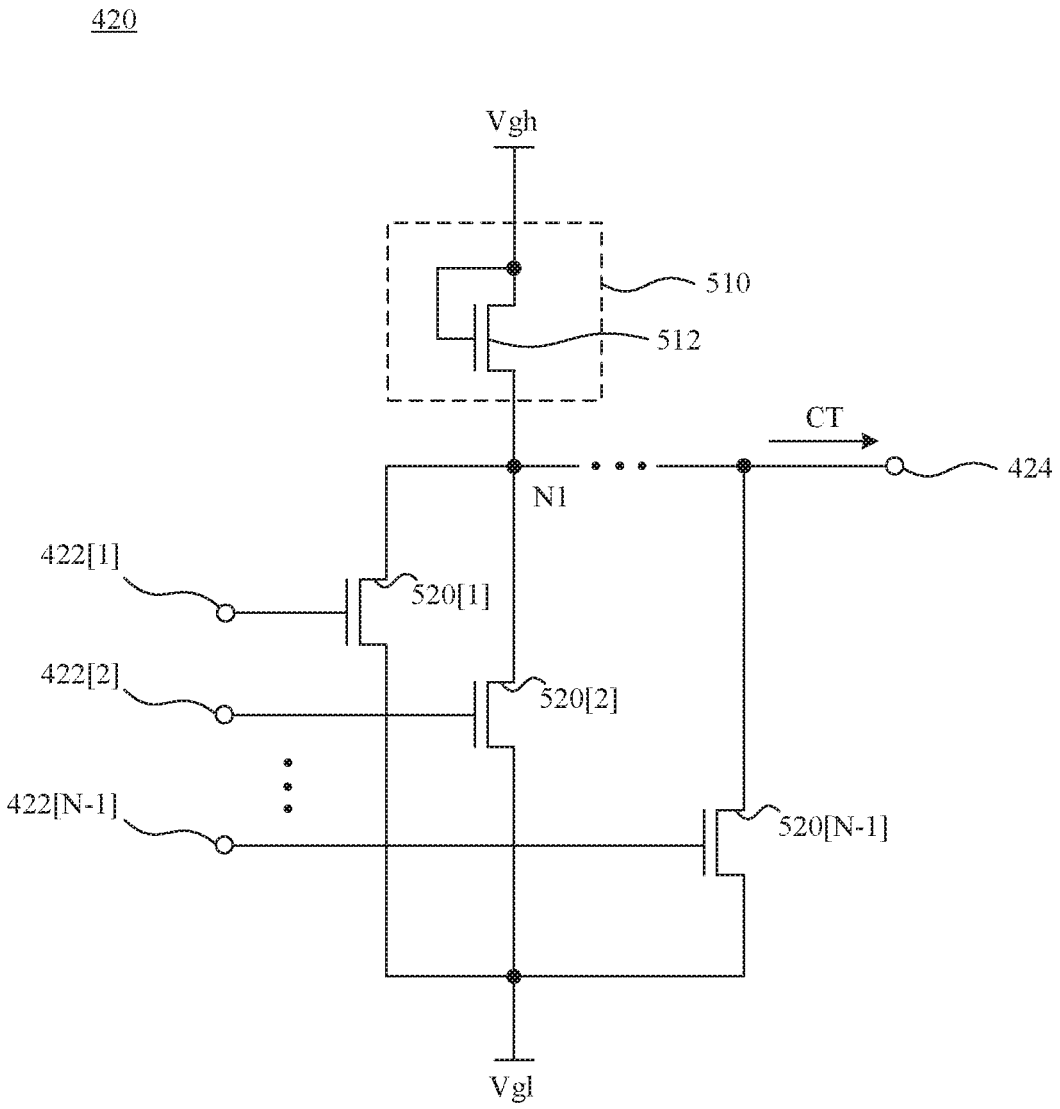
FIG. 5 is a simplified schematic diagram of the NOR gate according to one embodiment of the disclosure.

FIG. 5 is a simplified schematic diagram of the NOR gate 420 according to one embodiment of the disclosure. The NOR gate 420 comprises a pull-up element 510 and a plurality of pull-down transistors 520[1]-520[N−1]. The pull-up element 510 comprises a first node and a second node. The first node of the pull-up element 510 is configured to receive a first reference voltage Vgh. The second node of the pull-up element 510 is coupled with the first nodal point N1. Notably, the first nodal point N1 is coupled with the output node 424 of the NOR gate 420.

Each of the pull-down transistors 520[1]-520[N−1] comprises a first node, a second node, and a control node. With respect to an unspecific pull-down transistor 520, the first node is coupled with the first nodal point N1 and the second node is configured to receive the second reference voltage Vgl. The control node of the pull-down transistor 520 is coupled with one of the input nodes 422[1]-422[N−1] of the NOR gate 420 to receive one of the switching signals Sw[1]-Sw[N−1]. For example, the control node of the pull-down transistor 520[1] is coupled with the input node 422[1], and configured to receive the switching signal Sw[1]. In another example, the control node of the pull-down transistor 520[2] is coupled with the input node 422[2], and configured to receive the switching signal Sw[2]. In yet another example, the control node of the pull-down transistor 520[N−1] is coupled with the input node 422[N−1], and configured to receive the switching signal Sw[N−1], and so forth.

The pull-up element 510 comprises a pull-up transistor 512. The pull-up transistor 512 comprises a first node, a second node, and a control node. The first node and the control node of the pull-up transistor 512 are coupled together. In addition, the first node and the control node of the pull-up transistor 512 are configured to receive the first reference voltage Vgh. The second node of the pull-up transistor 512 is coupled with the first nodal point N1.

In this embodiment, the first reference voltage Vgh is higher than the second reference voltage Vgl, and the width-to-length ratio of the pull-down transistor 520 is larger than that of the pull-up transistor 512. Therefore, when one of the switching signals Sw[1]-Sw[N−1] has the enabling voltage level to conduct the pull-down transistor 520, the first nodal point N1 has a voltage level similar to the second reference voltage Vgl. As a result, the control signal CT has the disabling voltage level.

On the contrary, when each of the switching signals Sw[1]-Sw[N−1] has the disabling voltage level to switch off the pull-down transistors 520[1]-520[N−1], the first nodal point N1 has a voltage level similar to the first reference voltage Vgh. As a result, the control signal CT has the enabling voltage level.

In practice, the pull-down transistors 520[1]-520[N−1] and the pull-up transistor 512 may be realized by various categories of N-type transistors, such as the N-type TFTs.

Figure 6:
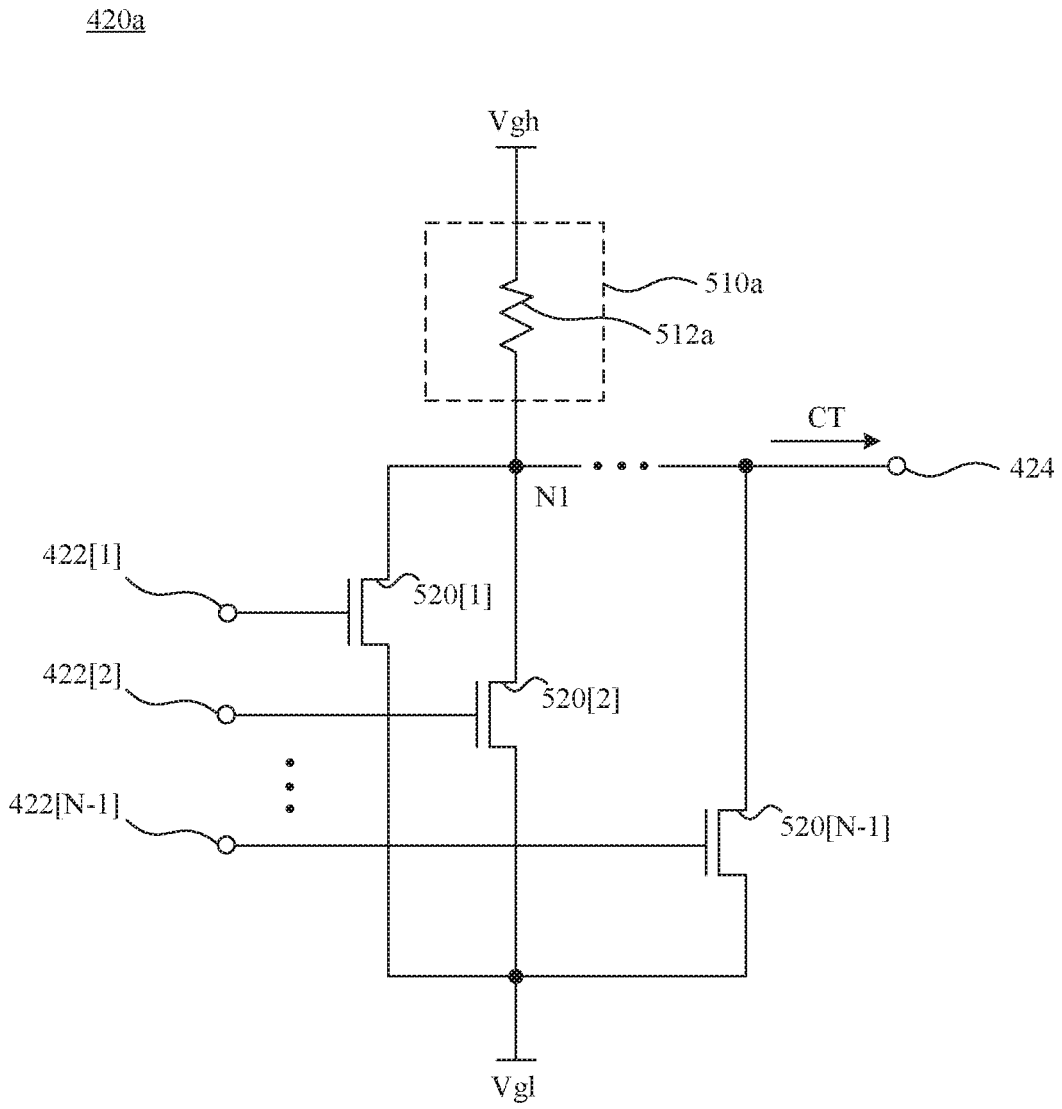
FIG. 6 is a simplified schematic diagram of the NOR gate according to another embodiment of the disclosure.

FIG. 6 is a simplified schematic diagram of a NOR gate 420*a* according to one embodiment of the present disclosure. The NOR gate 420*a* is applicable to the current-dividing element 220, and is similar to the NOR gate 420. The difference is that, the pull-up element 510*a* of the NOR gate 420*a* comprises a current-limiting resistor 512*a*. The current-limiting resistor 512*a* comprises a first node and a second node. The first node of the current-limiting resistor 512*a* is configured to receive the first reference voltage Vgh. The second node of the current-limiting resistor 512*a* is coupled with the first nodal point N1. The foregoing descriptions regarding the implementations, connections, operations, and related advantages of other corresponding components in the NOR gate 420 are also applicable to the NOR gate 420*a*. For the sake of brevity, those descriptions will not be repeated here.

As can be appreciated from the foregoing descriptions, the current-dividing element 220 and the current-dividing switches 210[1]-210[N−1] of the multiplexer 110 are together controlled by the switching signals Sw[1]-Sw[N], so that a number of control signals required by the display device 100 is reduced to decrease the number of impulse noises. In addition, the current-dividing element 220 prevents the multiplexer 110 from charging two data lines DL in the same time, so that the multiplexer 110 has sufficient charging capability for each data line DL. Therefore, the display device 100 is capable of providing high-quality and high-resolution images. Furthermore, when the display device 100 is integrated with a touch panel, the display device 100 will not induce erroneous acts of the touch panel.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

In addition, the singular forms "a," "an," and "the" herein are intended to comprise the plural forms as well, unless the context clearly indicates otherwise.

Although the present disclosure has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A display device, comprising a plurality of pixels, and further comprising:

a plurality of multiplexers, wherein each of the plurality of multiplexers is coupled with N data lines, and configured to receive N−1 switching signals and a data signal, wherein each of the plurality of multiplexers comprises:

N−1 current-dividing switches, wherein each of the N−1 current-dividing switches comprises a first node, a second node, and a control node, wherein the first nodes of the N−1 current-dividing switches are respectively coupled with a first data line through an (N−1)-th data line of the N data lines, the second nodes of the N−1 current-dividing switches are configured to receive the data signal, and the control nodes of the N−1 current-dividing switches are configured to respectively receive the N−1 switching signals; and a current-dividing circuit, configured to receive the N−1 switching signals and the data signal, coupled with the N-th data line, and comprising a driving transistor and a NOR gate, wherein a first node of the driving transistor is coupled with an N-th data line of the N data line, and a second node of the driving transistor is configured to receive the data signal, wherein N−1 input nodes of the NOR gate are configured to respectively receive the N−1 switching signals, and an output node of the NOR gate is coupled with a control node of the driving transistor, wherein N is a positive integer larger than or equal to 3, and each of the N data lines is coupled with one column of pixels of the plurality of pixels, wherein when any of the N−1 switching signals has an enabling voltage level, the current-dividing circuit is disabled from transmitting the data signal to the N-th data line and the multiplexer sequentially transmits the data signal to the first data line through the (N−1)-th data line, when each of the N−1 switching signals has a disabling voltage level, the current-dividing circuit transmits the data signal to the N-th data line and the multiplexer is disabled from transmitting the data signal to the first data line through the (N−1)-th data line.

2. The display device of claim 1, wherein the NOR gate comprises:

a pull-up element, comprising a first node and a second node, wherein the first node of the pull-up element is configured to receive a first reference voltage, and the second node of the pull-up element is coupled with a first nodal point; and N−1 pull-down transistors, wherein each of the N−1 pull-down transistors comprises a first node, a second node, and a control node, the first node of the pull-down transistor is coupled with the first nodal point, the second node of the pull-down transistor is configured to receive a second reference voltage, and the control node of the pull-down transistor is coupled with one of the N−1 input nodes of the NOR gate, wherein the first nodal point is coupled with the output node of the NOR gate.

3. The display device of claim 2, wherein the pull-up element comprises:

a pull-up transistor, comprising a first node, a second node, and a control node, wherein the first node of the pull-up transistor is coupled with the control node of the pull-up transistor, the first node of the pull-up transistor is configured to receive the first reference voltage, and the second node of the pull-up transistor is coupled with the first nodal point.

4. The display device of claim 2, wherein the pull-up element comprises:

a current-limiting resistor, comprising a first node and a second node, wherein the first node of the current-limiting resistor is configured to receive the first reference voltage, and the second node of the current-limiting resistor is coupled with the first nodal point.

5. A multiplexer, applicable to a display device comprising a plurality of pixels, wherein the multiplexer is coupled with N data lines, and configured to receive N−1 switching signals and a data signal, wherein the multiplexer comprises:

N−1 current-dividing switches, wherein each of the N−1 current-dividing switches comprises a first node, a second node, and a control node, wherein the first nodes of the N−1 current-dividing switches are respectively coupled with a first data line through an (N−1)-th data line of the N data lines, the second nodes of the N−1 current-dividing switches are configured to receive the data signal, and the control nodes of the N−1 current-dividing switches are configured to respectively receive the N−1 switching signals; and a current-dividing circuit, configured to receive the N−1 switching signals and the data signal, coupled with the N-th data line, and comprising a driving transistor and a NOR gate, wherein a first node of the driving transistor is coupled with an N-th data line of the N data line, and a second node of the driving transistor is configured to receive the data signal, wherein N−1 input nodes of the NOR gate are configured to respectively receive the N−1 switching signals, and an output node of the NOR gate is coupled with a control node of the driving transistor, wherein N is a positive integer larger than or equal to 3, and each of the N data lines is coupled with a column of pixels of the plurality of pixels, wherein when any of the N−1 switching signals has an enabling voltage level, the current-dividing circuit is disabled from transmitting the data signal to the N-th data line and the multiplexer sequentially transmits the data signal to the first data line through the (N−1)-th data line, when each of the N−1 switching signals has a disabling voltage level, the current-dividing circuit transmits the data signal to the N-th data line and the multiplexer is disabled from transmitting the data signal to the first data line through the (N−1)-th data line.

6. The multiplexer of claim 5, wherein the NOR gate comprises:

a pull-up element, comprising a first node and a second node, wherein the first node of the pull-up element is configured to receive a first reference voltage, and the second node of the pull-up element is coupled with a first nodal point; and N−1 pull-down transistors, wherein each of the N−1 pull-down transistors comprises a first node, a second node, and a control node, the first node of the pull-down transistor is coupled with the first nodal point, the second node of the pull-down transistor is configured to receive a second reference voltage, and the control node of the pull-down transistor is coupled with one of the N−1 input nodes of the NOR gate, wherein the first nodal point is coupled with the output node of the NOR gate.

7. The multiplexer of claim 6, wherein the pull-up element comprises:

a pull-up transistor, comprising a first node, a second node, and a control node, wherein the first node of the pull-up transistor is coupled with the control node of the pull-up transistor, the first node of the pull-up transistor is configured to receive the first reference voltage, and the second node of the pull-up transistor is coupled with the first nodal point.

8. The multiplexer of claim 6, wherein the pull-up element comprises:

a current-limiting resistor, comprising a first node and a second node, wherein the first node of the current-limiting resistor is configured to receive the first reference voltage, and the second node of the current-limiting resistor is coupled with the first nodal point.

* * * * *